United States Patent [19]

Leithauser et al.

[11] 4,411,138

[45] Oct. 25, 1983

[54] NECK TUBE CLOSURE ASSEMBLY FOR CRYOGENIC CONTAINERS

[75] Inventors: Douglas R. Leithauser, Indianapolis; John K. Young, Carmel, both of Ind.

[73] Assignee: Union Carbide Corporation, Danbury, Conn.

[21] Appl. No.: 408,915

[22] Filed: Aug. 17, 1982

[51] Int. Cl.[3] ..... F17C 7/02

[52] U.S. Cl. ..... 62/50; 62/514 R; 220/353; 220/367

[58] Field of Search ..... 62/45, 514 R, 50; 220/366, 367, 353

[56] References Cited

U.S. PATENT DOCUMENTS

| | | | |
|---|---|---|---|
| 1,654,474 | 12/1927 | Wolter | 220/366 |
| 3,069,044 | 12/1962 | Haumann | 220/14 |
| 3,168,362 | 2/1965 | Perkins | 312/214 |
| 3,207,354 | 9/1965 | Skinner et al. | 220/15 |
| 3,910,441 | 10/1975 | Bramming | 215/13 R |
| 3,938,346 | 2/1976 | Ovchimnikov et al. | 62/50 |

*Primary Examiner*—Ronald C. Capossela

*Attorney, Agent, or Firm*—Eugene Lieberstein

[57] ABSTRACT

A double walled nonpressurized cryogenic storage container having an elongated neck tube in combination with a closure assembly for the neck tube. The closure assembly includes a neck plug and a neck tube adapter having access means for sensor and fill lines. The neck tube adapter has an outer shell and an inner shell with a multiplicity of radially projecting spacer elements for establishing an annular space between the outer shell and the neck tube. The inner shell is preferably eccentric to the outer shell.

15 Claims, 8 Drawing Figures

NECK TUBE CLOSURE ASSEMBLY FOR CRYOGENIC CONTAINERS

This invention relates to cryogenic containers and more particularly to a neck tube closure assembly for non-pressurized cryogenic storage containers.

Non-pressurized cryogenic storage containers, are double walled vacuum insulated vessels which are partially filled with a cryogen, e.g. liquid nitrogen which boils at 77.4 K.(−320.4° F.), for establishing an extremely cold environment inside the container. The interior of the container is used for storing such biologicals, as whole blood, bone marrow, micro-organic cultures, semen, etc., all of which must be maintained at very low temperatures if they are to be sustained for a long time, without deterioration.

Access to the interior of the container is provided through a thin-walled neck tube having a generally cylindrical configuration which extends vertically from the outer container wall to the inner container wall. The neck tube is sized to provide an aperture large enough for introducing and removing perishable products from the interior of the container.

Under normal storage conditions, that is, when no product is being introduced into the vessel or withdrawn from it, the open neck tube should always remain closed. The device used for this purpose resembles a plug which extends into the vessel for generally the length of the neck tube. It is made of a low heat conducting material to block any heat transfer to the cryogen by convection and to reduce heat transfer by radiation. Depending on the size of the neck tube the plug may consist of one or more removable sections.

About one third of all the heat that flows into a cryogenic container, equipped with a large diameter neck tube, is by solid conduction. The individual channels for heat flow can be identified as:

the neck tube;
the supply line for the cryogen refill;
electric conduits for the liquid level control system;
electric conduits for the alarm system contol;
the neck plug
mechanical support system for electric and fluid lines.

All the channels cited above conduct the heat in a generally downward direction, that is, from the ambient-warm outer casing of the container into the cryogen held by the inner vessel. However, the super-cold vaporized gas, at 77.6 K.(−320° F.), which is continuously boiling off from the cryogen as a result of the heat inflow from all sources, is moving upwards in a counter-current fashion in comparison with the direction of the heat flow. An annular gap is formed between the inner wall of the neck tube and the outer wall of the neck plug to provide an exit path for the boiled-off gas. It has been discovered in accordance with the present invention that the dimensions of the exit path be maintained under all circumstances constant to maximize the heat exchange between the heat-abundant components of the neck tube/neck plug system and the heat-deficient molecules of the cold exit gas, so that the thermodynamically ideal condition be approximated as close as possible and that the temperature of the exit gas be near ambient temperature at the point of exit. The net effect of the exchange is that a smaller amount of heat will be reaching the cryogen thus improving the overall efficiency of the cryogenic container.

It has been further discovered in accordance with the present invention that misalignment of the neck plug in the neck tube alters the rate of heat exchange with the neck tube so as to diminish heat transfer along the neck tube with the escaping gas. This reduces the utilization of the available refrigeration of the efluent gaseous cryogen. Misalignment may be due to non-concentricity between the neck plug in the neck tube resulting from manufacturing variations in tolerance, replacement inaccuracy, or structural imperfections. Such variations or imperfections will usually cause an out-of-round condition in either the neck plug or neck tube or both. As a result of such misalignment there is a substantial probability that the neck plug will make physical contact along one side of the neck tube and, accordingly, leave a larger than desired clearance on the opposite side of the neck tube. Wherever the neck plug touches the neck tube there is no flow of cold gas to pick up the inleaking heat. For larger diameter neck tubes contact between the neck plug and the neck tube spans over a curved area along the neck tube in which little or no heat may be recovered for lack of an adequate heat sink provided by the effluent gaseous cryogen. On the side of the neck plug opposite the area of contact, the clearance will necessarily be much larger than originally intended. An oversized clearance will also inhibit heat transfer due to a decrease in exit gas velocity. For the larger size containers, classified by the size of the neck tube and typically having a neck tube size of over about 355 mm (14") in diameter to about 760 mm (30") in diameter, the loss in heat exchange attributable to such misalignment can be as high as 25% or more over optimum conditions.

There are two problems common with past design control and/or alarm system component routing. First is the inability to remove and replace lines run through the vacuum space of an in-service refrigerator. Frequently the tubing is small to minimize heat transfer and bent to enter the vertical wall of the inner vessel. This precludes adjusting such control devices due to both the positioning logistics and ice formation from moisture laden air condensing and then freezing in the tubing. Modification can only be accomplished after the stored product is moved to a standby refrigerator and warming the entire problem refrigerator to work inside it.

The second but related problem is that when these system components and fill lines are located in the annular gap between the neck plug and neck tube the condensation and freezing problem is exaggerated. Because there is no seal to prevent moisture from migrating into the refrigerator via the cold external surfaces passing through the annual gap these items tend to freeze to the neck tube and/or neck plug.

The auxiliary fill or sensor lines should be free to be removed for modification or substitution by a spare part. In commercially available systems the fill and sensor lines are fixed in place. In case of malfunction the entire cryogenic container becomes unserviceable, endangering the integrity of the entire load of biologicals (often times irreplaceable).

It is therefore the principle object of the present invention to provide a neck tube closure assembly for non-pressurized cryogenic containers which assures a uniform clearance space of predetermined cross sectional area between the neck tube closure assembly and the neck tube.

It is another object of the present invention to provide a neck tube closure assembly for a cryogenic container which includes, in combination, a neck plug and neck tube adapter having internal access passageways for introducing supply and control lines into the interior of the container.

DETAILED DESCRIPTION OF THE INVENTION

Other objects and advantages of the present invention will become apparent from the following detailed description of the invention when read in conjunction with the accompanying drawing of which:

Figure 1:
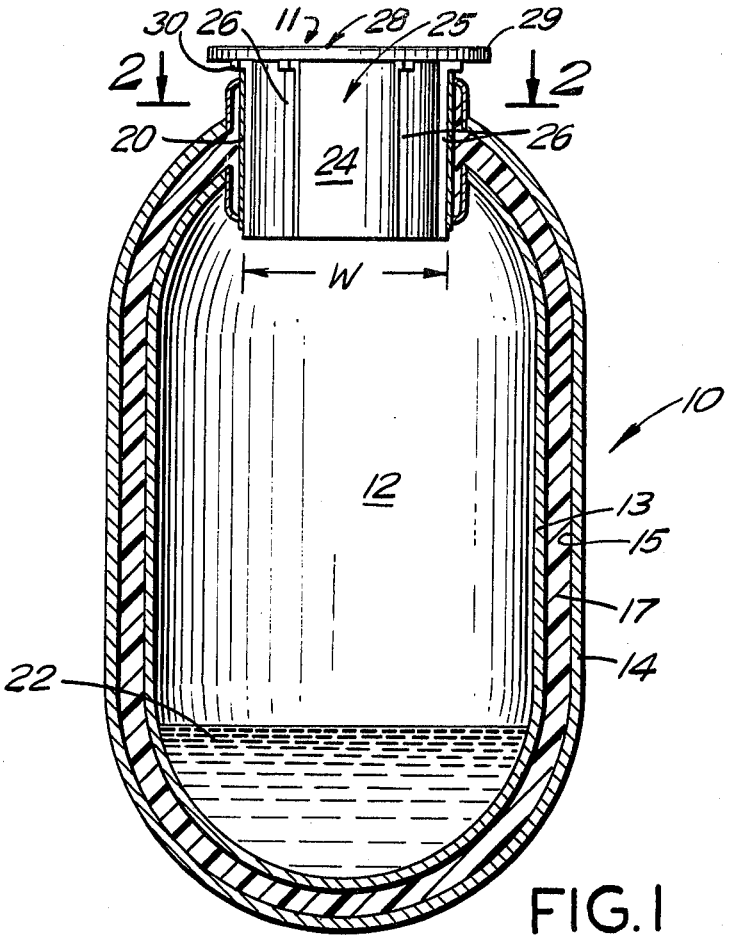
FIG. 1 is a cross section of a typical cryogenic container in combination with a diagrammatic illustration of the neck tube closure assembly of the present invention.
Figure 2:
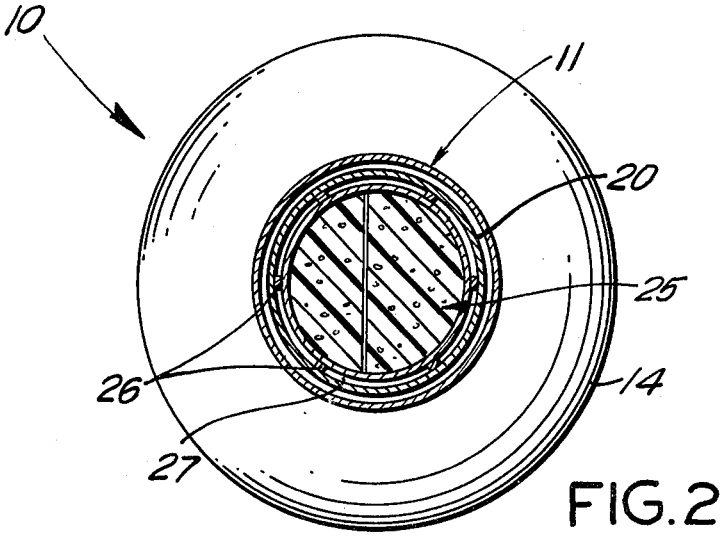
FIG. 2 is a plan view taken along the lines 2—2 of FIG. 1.
Figure 3:
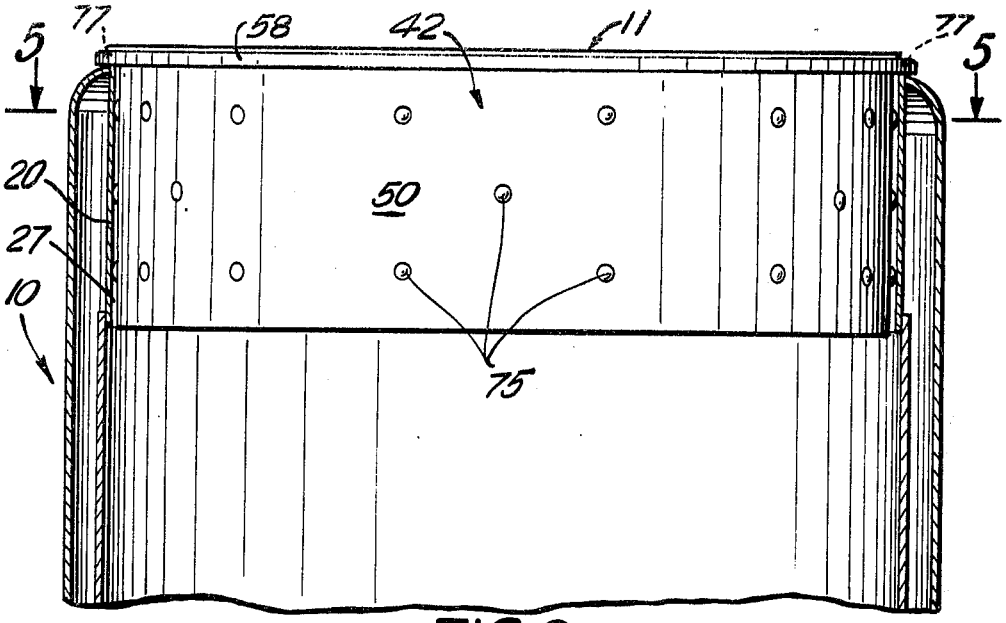
FIG. 3 is a side elevation of a preferred embodiment of the neck tube closure assembly of the present invention seated within the neck tube of a cryogenic container shown in cross section.
Figure 5:
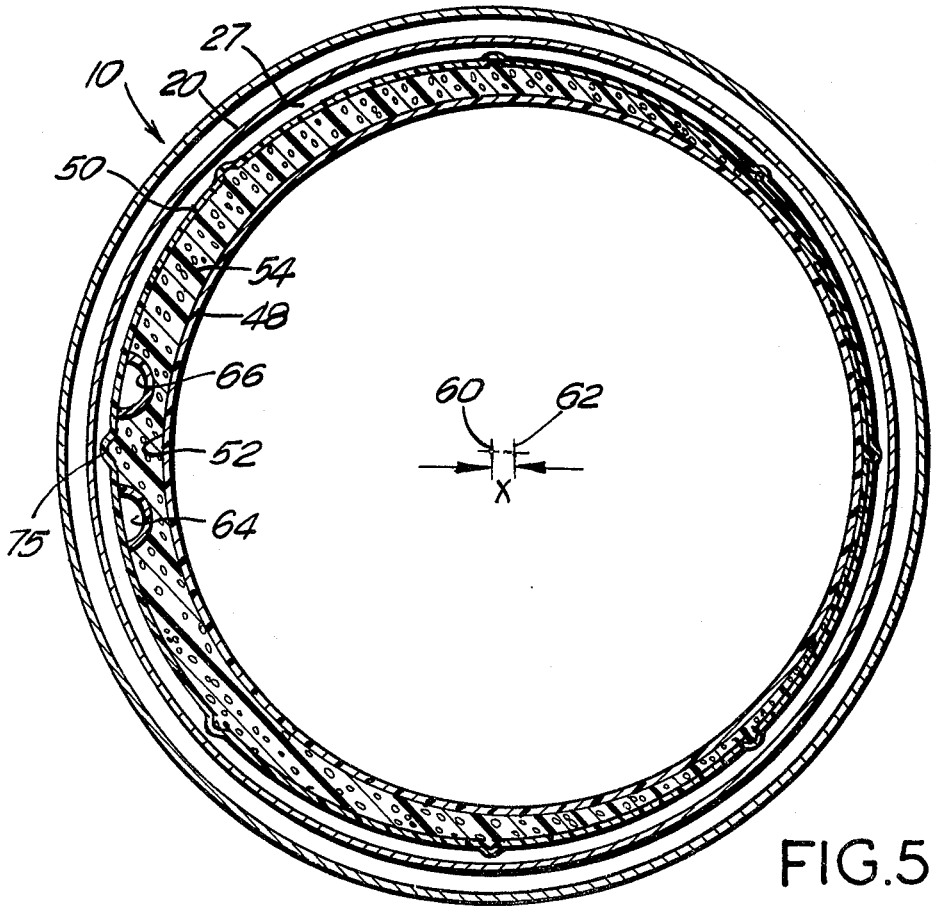
FIG. 5 is another plan view taken along lines 5—5 of FIG. 3.
Figure 4:
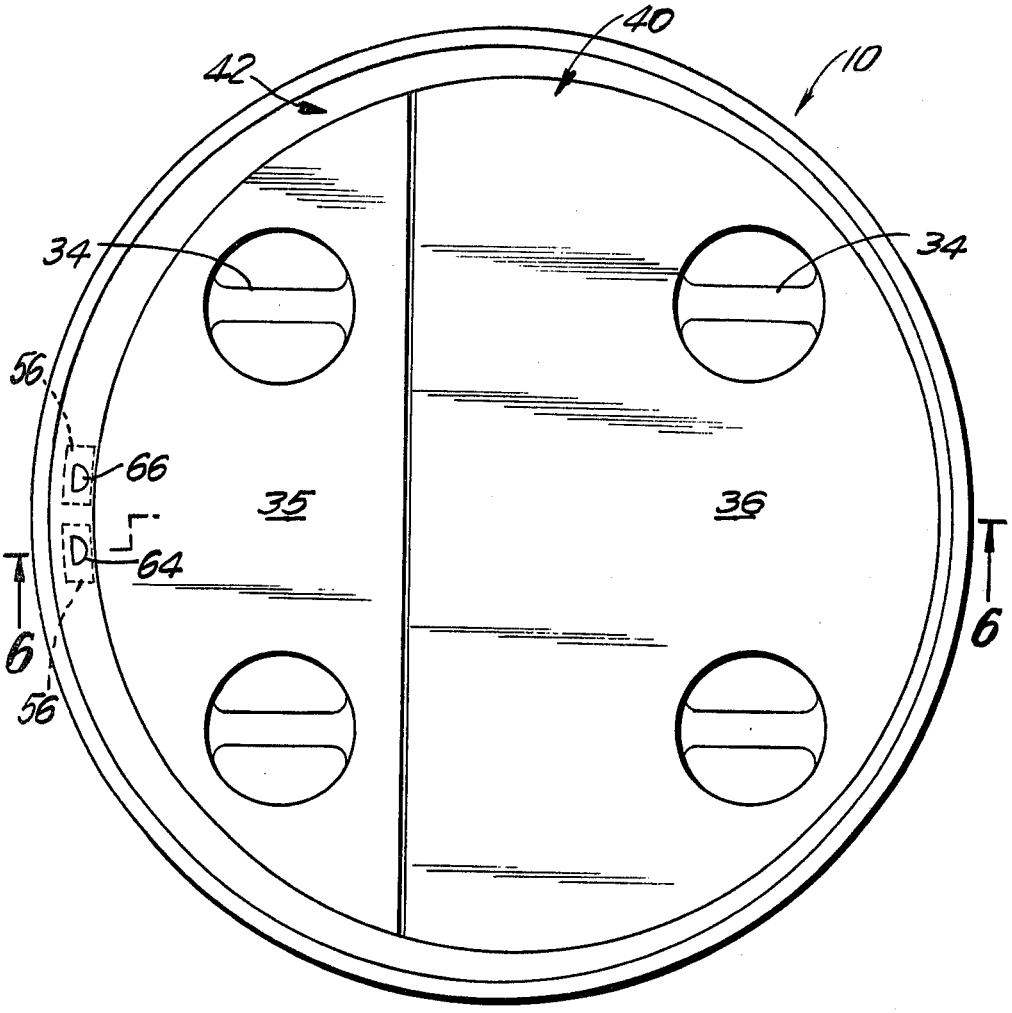
FIG. 4 is a plan view of FIG. 3.

Referring now to FIGS. 1 and 2 inclusive in which a conventional double walled non-pressurized cryogenic container 10 is diagrammatically illustrated in combination with a removable closure assembly 11 for providing access to the interior 12 of the container 10. The container 10 includes an inner wall 13 preferably of stainless steel and an outer wall 14 separated from the inner wall 13 by a vacuum space 15 which is filled with any conventional insulating material 17. Although any conventional insulating material 17 may be used a multilayer insulation system is preferred.

A thin walled elongated neck tube 20 traverses the container 10 in a substantially vertical disposition extending from the outer wall 14 to the inner wall 13 to provide an access opening into the container 10 defined by the geometry of the neck tube 20. The neck tube 20 is preferably made of stainless steel and is preferably cylindrical in geometry. A liquid cryogenic refrigerant 22 such as liquid nitrogen is introduced into the interior 12 of the container 10 to establish a cryogenic environment. The closure assembly 11 is removably inserted into the neck tube 20 to provide an annular clearance space 27 between the assembly 11 and the neck tube 20 with a predetermined cross sectional area as will hereafter be explained in greater detail.

The closure assembly 11 is comprised of a low heat conductive plug 25 having an elongated body 24 surrounded by a multiple number of spacer elements 26 preferably arranged about the periphery of the body 24 in a generally longitudinal alignment with the neck tube 20 to define a controlled annular space 27 of uniform cross section between the plug 25 and the neck tube 20. The periphery of the plug body 24 should conform to the geometry of the neck tube 20. The plug 25 should have a cross sectional width approximately equal to the cross sectional width "W" of the neck tube 20 less twice the thickness of the spacer elements 26 as measured radially from the central axis of the plug 25 so that the plug 25 and spacer elements 26 fit closely against the neck tube 20. The spacer elements 26 are intended to cause the plug 25 to assume a concentric relationship within the neck tube 20 which will assure uniformity in the annular space 27 each time the plug 25 is inserted into the neck tube 20.

The plug 25 has a cover plate 28 with an annular rim 29 which overhangs the body of the plug 25 to support the plug 25 in the neck tube 20. Each longitudinally disposed spacer element 26 has a radial end section 30 contiguous with the underside of the annular rim 29 which separates the cover plate 28 from the top of the neck tube 20 and extends the annular clearance 27 between the cover plate 28 and the top of the neck tube 20 with an essentially uniform cross sectional area.

The spacer elements 26 can be part of the plug 25 or as a part of the neck tube adapter 42 as will be explained in more detail in connection with the preferred embodiment of the invention illustrated in FIGS. 3 to 8 inclusive. Although the spacer elements 26 are shown in the form of vertically oriented ribs any type of projection with any orientation may be used. In fact it is possible to use raised projections or dimples as will be more fully explained in connection with the preferred embodiment of FIGS. 3–8. Any number of spacer elements 26 may be used and in any desired arrangement which will maintain an annular clearance 27 between the plug 25 and the neck tube 20 provided they occupy a minimum of the annular space 27.

The preferred embodiment of the closure assembly 11 of the present invention is shown in FIGS. 3–8 inclusive. In this embodiment the closure assembly 11 comprises a low heat conductive neck plug 40 and a neck tube adapter 42 which separates the neck plug 40 from the neck tube 20 and assures an annular clearance 27 of uniform cross sectional area about the neck tube 20 as will be explained in greater detail hereafter. Like reference numerals are used to denote functionally equivalent parts between the embodiments of FIGS. 1–2 and that of FIGS. 3–8.

The neck plug 40 is of a generally cylindrical configuration which for larger diameter neck tubes is preferably constructed of two removable sections 35 and 36 respectively, with each section containing a suitable insulation filler material 38 such as polyurethane and handles 34. The two sections 35 and 36 have mated beveled ends 39 and 41 which combine to provide the neck plug 40 with a uniform cylindrical periphery. A cover plate 43 and 45 is provided for each section 35 and 36 respectively. The cover plates 43 and 45 overlap at the beveled ends 39 and 41 to form an overlapping joint 46. A gasket 47 is disposed along the overlapping joint 46 to form a seal. Each cover plate 43 and 45 overhangs the respective section 35 and 36 of the neck plug 40 to form peripheral lids 49 and 51 which engage the neck tube adapter 42 for support.

The neck tube adapter 42 is formed from two shells 48 and 50 spaced apart to form a gap 52 which is filled with an insulating material 54 such as polyurethane. A flange 55 connects the outer shell 50 to the inner shell 48 and forms an annular rim 58 which overhangs the outer shell 50. The annular rim 58 which is supported by spacer 77 is intended to rest upon the neck tube 20 to support the adapter 42 and to provide adequate support for the neck plug 40 when inserted into the hollow inner shell 48.

The inner and outer shells 48 and 50 of the neck tube adapter 42 may be formed from any suitable low heat conductive material and preferably of a plastic composition such as polycarbonate. The inner shell 48 may be vacuum formed with a radial upper flange forming the annular rim 58. The outer shell should conform to the geometry of the neck tube 20 and accordingly will be cylindrical in shape for a cylindrical neck tube 20. The outer shell 50 is bonded to the flange 55 so that it suspends therefrom in a normal direction with its longitudinal axis 60 adapted to coincide with the longitudinal axis of the neck tube 20 to form a concentric relationship therewith. However, the longitudinal axis 60 of the outer shell 50 could be offset a predetermined distance "X" from the longitudinal axis 62 of the inner shell 48 to form an eccentric relationship thereto. This would cause the gap 52 between the outer shell 50 and the inner shell 48 to be non-symmetrical in cross section, i.e., wider in cross section on one side and narrower on the other which therefore maximizes the access opening. This is clearly apparent from FIGS. 4, 5 and 6.

Figure 6:
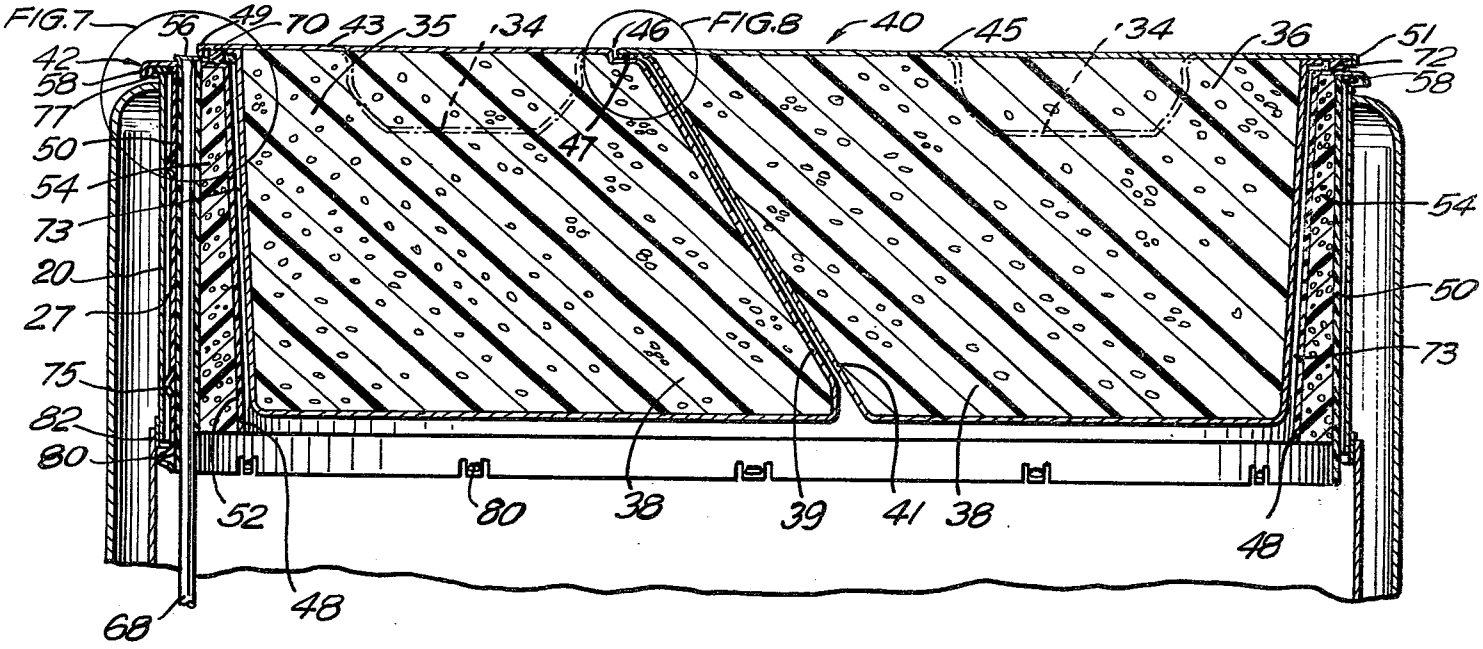
FIG. 6 is a side elevation shown in cross section of the container and neck tube closure assembly of the present invention taken along the lines 6—6 of FIG. 4.
Figure 7:
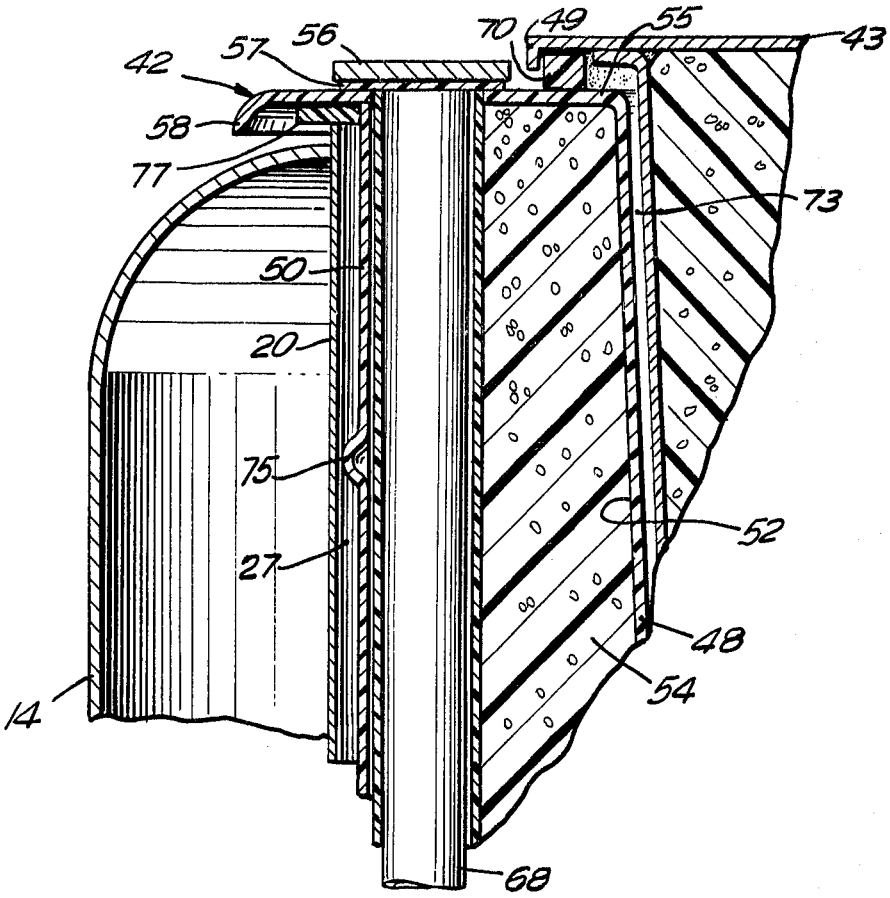
FIG. 7 is an enlarged view of the encircled area identifying this figure.
Figure 8:
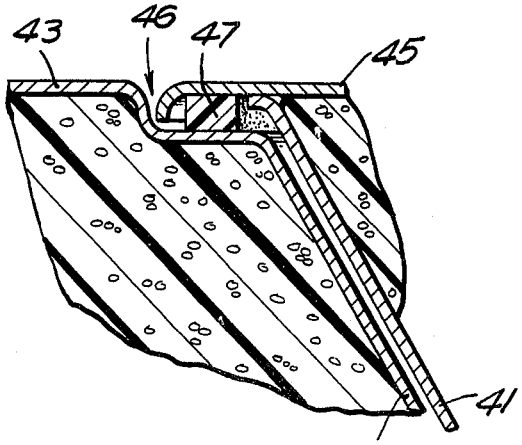
FIG. 8 is an enlarged view of the encircled area identifying this figure.

Access slots 64 and 66 are formed in the annular rim 58 of the neck tube adapter 42 and extend through the gap 52 on the wider side between the inner and outer shells 48 and 50. The access slots 64 and 66 are sized to permit sensor lines and fill lines to be inserted for monitoring and maintaining the level of cryogenic refrigerant in the container. An example sensor line 68 is shown in FIG. 6 extending through the access slot 64. The access slots are substantially in vertical alignment relative to the longitudinal axis 60. The geometry of the access slots 64 and 66 are not significant to the invention although a "D" shaped slot has been found desirable. The access slots 64 and 66 should each be covered with a removable cover plate 56 connected to the flange 55 and separated by a gasket 57. The senor line 68 may be bonded to the cover plate 56 to form a unitary structure. The gasket 57 forms a seal between the cover plate 56 and the flange 55.

The geometry of the inner shell 48 and the disposition of its longitudinal axis 62 relative to the longitudinal axis of the neck plug 40 is not critical to the invention. Accordingly, the inner shell 48 is preferably slightly tapered during vacuum forming to facilitate the insertion of the neck plug 40 which can also be vacuum formed. The neck plug 40 need not be concentric with the outer shell 50. Each section 35 and 36 of the neck plug 40 has a gasket 70 and 72 located beneath the rims 49 and 51 of the cover plates 43 and 45 respectively. Gaskets 70 and 72 seal the space 73 between the inner shell 48 and the periphery of each section 35 and 36 of the neck plug 40.

A plurality of spacer elements 75 radially extend from the outer shell 50 of the neck tube adapter 42 a distance substantially equal to the width of the clearance space 27. The spacer elements 75 are intended to function in a manner equivalent to the counterpart spacer elements 26 of FIGS. 1 and 2, although of substantially different geometry. In fact, the spacer elements 75 may have any desired shape but are preferably formed as raised dimples extending from the outer shell 50 as an integral component thereof. The spacer elements 75 may be arranged in any desired pattern so long as they are distributed around the circumference of the outer shell 50 to assure an annular clearance 27 between the outer shell 50 and the neck tube 20. As explained in connection with FIGS. 1 and 2, any arrangement of spacer elements 75 may be used and any number, provided in total they occupy a minimum of the annular space 27 by volume.

Additional spacer elements 77 should be provided below the annular rim 58 dispersed from one another to form an annular pattern around the rim 58 which extends the clearance space 27 into direct communication with the ambient atmosphere. Once again the spacer elements 77 should occupy very little of the extended open clearance space 27 provided between spacer elements 77. The extended open clearance space 27 should also provide continuity with the clearance space established by the spacer elements 75.

To simplify the insertion of the neck tube adapter 42 into the neck tube 20 the lowermost spacer elements 80 should radially extend a slight distance greater than the width of the clearance space 27 so as to lock the tube adapter 42 in place as soon as the elements 80 clear the end 82 of the neck tube 20. The spacer elements 75 and in particular the longer spacer elements 80 must be resilient to provide enough spring action so that the neck tube adapter 42 is easily inserted into the neck tube 20 without requiring too much force.

What we claim is:

1. In combination a cryogenic storage container having inner and outer walls separated by a vacuum space filled with insulating material, an elongated neck tube traversing the outer and inner walls in a substantially vertical direction from the designated top end of the container to provide therethrough an access opening into the interior of the container for introducing and removing perishable products with said neck tube having a predetermined geometry and size, a predetermined measure of a cryogenic refrigerant located within the interior of said container, and a closure assembly removably inserted within said neck tube, said closure assembly comprising;

a neck plug having an elongated body with a periphery conforming in geometry to the geometry of the neck tube;

a cover plate transversely mounted upon said neck plug and having an annular rim overhanging said neck plug for supporting said neck plug in said neck tube; and a multiplicity of spacer elements arranged about the periphery of said neck plug and radially extending therefrom to establish a concentric relationship between said neck plug and neck tube and to form an annular clearance space therebetween which is uniform in cross sectional dimension and with additional spacer elements for separating said rim of said cover plate from said container so as to extend said clearance space therebetween, said spacer elements occupying a minimum of space within said annular clearance space.

2. In the combination of claim 1 wherein each of said multiplicity of spacer elements represents a relatively thin elongated rib in relative alignment with the longitudinal axis of the plug.

3. In the combination of claim 2 wherein each of said additional spacer elements represent radial extensions of each elongated rib disposed contiguous to said rim of said cover plate.

4. In the combination of claim 1 wherein said multiplicity of spacer elements represent raised dimples extending from the body of said plug.

5. In combination a cryogenic storage container having inner and outer walls separated by a vacuum space filled with insulating material, an elongated neck tube traversing the outer and inner walls in a substantially vertical direction from the designated top end of the container to provide therethrough an access opening into the interior of the container for introducing and removing perishable products with said neck tube having a predetermined geometry and cross sectional dimension, a predetermined measure of cryogenic refrigerant located within the interior of said container and a closure assembly removably inserted within said neck tube, said closure assembly comprising:

a neck plug;

a neck tube adapter having an outer shell conforming in geometry to the geometry of said neck tube with a cross sectional dimension smaller than said cross sectional dimension of said neck tube and an inner shell separated from said outer shell to form a gap therebetween, said inner shell having a geometry adapted to removably receive said neck plug;

means for maintaining said neck plug in sealed engagement with said neck tube adapter upon being inserted into said inner shell;

means for insulating said gap between said outer and inner shell;

cover means extending from said inner shell to said outer shell for forming a rim about said neck tube adapter; and a multiplicity of spacer elements arranged about the periphery of said outer shell and radially extending therefrom for engaging said neck tube to form a uniform annular clearance space between the outer shell and said neck tube upon insertion of said neck tube adapter into said neck tube.

6. In the combination of claim 5 further comprising at least one additional access opening to the interior of said container adapted for insertion of a control and/or supply line with said access opening being disposed in said neck tube adapter and extending through the gap formed between said outer and inner shell.

7. In the combination of claim 6 wherein said outer shell and said inner shell are eccentrically disposed relative to one another with their longitudinal axis offset a predetermined distance such that the neck tube adapter is wider in cross section on one side relative to the opposite side.

8. In the combination of claim 7 wherein said additional access opening extends through said neck tube adapter on said wider side thereof.

9. In the combination of claim 8 wherein said access opening traverses said cover means and extends substantially in longitudinal alignment with the longitudinal axis of the outer shell.

10. In the combination of claim 9 further comprising at least a second access opening disposed adjacent to and in parallel alignment with the other access opening.

11. In the combination according to claim 9 wherein the rim formed by said cover means overhangs said neck tube with the overhanging portion adapted to engage said container.

12. In the combination according to claims 6 or 11 wherein said multiplicity of spacer elements represent raised dimples extending from said outer shell.

13. In the combination of claim 12 further comprising an additional set of spacer elements disposed beneath the overhanging portion of said cover means and in engagement with said container for extending said uniform annular clearance space between said cover means and said container upon inserting said neck tube adapter into said neck tube.

14. In the combination of claim 13 further comprising a third set of spacer elements arranged about the periphery of said outer shell below the other spacer elements with said third set of spacer elements radially extending a predetermined distance greater than the radial distance extended by the other spacer elements so as to removably lock the neck plug adapter in place.

15. In the combination of claim 13 wherein said neck tube is cylindrical in geometry, said outer shell is cylindrical in geometry and concentric to said neck tube and wherein said inner shell is substantially cylindrical.

* * * * *